United States Patent [19]

Hessler

[11] Patent Number: 4,661,041

[45] Date of Patent: Apr. 28, 1987

[54] SELF-DRAINING PUMP ARRANGEMENT

[75] Inventor: William D. Hessler, Wyckoff, N.J.

[73] Assignee: ITT Corporation, New York, N.Y.

[21] Appl. No.: 795,396

[22] Filed: Nov. 5, 1985

[51] Int. Cl.[4] ..... F04D 5/00

[52] U.S. Cl. ..... 415/52; 415/53 R

[58] Field of Search ..... 415/52, 53 R, 53 T, 415/121 R, 121 A, 206

[56] References Cited

U.S. PATENT DOCUMENTS

| | | | |
|---|---|---|---|
| 2,734,460 | 2/1956 | Deters et al. | 415/11 |
| 3,070,025 | 12/1962 | Cliborn | 415/53 |
| 3,279,386 | 10/1966 | Rupp et al. | 415/53 |
| 3,322,071 | 5/1967 | Teter | 415/53 R |
| 3,348,514 | 10/1967 | Davis | 415/206 |
| 3,898,014 | 8/1975 | Meister et al. | 415/53 |
| 4,492,516 | 1/1985 | McCoy, Jr. | 415/53 |

*Primary Examiner*—Robert F. Garrett
*Assistant Examiner*—John Kwon
*Attorney, Agent, or Firm*—John T. O'Halloran; Robert P. Seitter

[57] ABSTRACT

A self-draining pump comprises a pump housing which bounds an impeller chamber having a central axis that is substantially horizontal in a position of use of the pump and an open end facing in one axial direction. An output passage of the pump housing communicates with a radially outward region of the impeller chamber. An impeller is received in the impeller chamber for rotation about the central axis for impelling fluid from a radially inward region toward the radially outward region of the impeller chamber. A lid includes a mounting portion mounted on the pump housing for closing the open end of the impeller chamber, an inlet portion axially spaced from the mounting portion and bounding an inlet passage which is centered on an inlet axis that is substantially parallel to the axis and offset therefrom by such a distance that a bottom zone of the inlet passage is at an elevation no higher than a bottom zone of the impeller chamber in the position of use, a connecting portion bounding an internal space connecting the inlet passage with a radial section of the impeller chamber which extends from the radially inward region to the bottom zone of the impeller chamber, and a partitioning wall situated in the internal space for delimiting therein a connecting passage leading from the inlet passage to the radially inward region of the impeller chamber, the partitioning wall including at least one aperture of a limited cross section which communicates the bottom zone of the impeller chamber with the bottom zone of the inlet passage for draining fluid from the bottom zone of the impeller chamber when the inlet passage is connected to a drain.

10 Claims, 4 Drawing Figures

SELF-DRAINING PUMP ARRANGEMENT

BACKGROUND OF THE INVENTION

The present invention relates generally to pumping arrangements, and more particularly to pumps which are completely self-draining when not being operated.

There are already known various pump constructions, among them such which are often being referred to as self-draining pumps. In pumps of this type, all of the liquid that is being pumped by the pump while in operation is drained out of the pump when the pump is not being operated. The reason for this may be, for instance, when the pump is being used as a recirculating pump in conjunction with a whirlpool bath, a spa, or a similar facility in which water is being recirculated, to assure that no stale water will remain in the pumping system where it could promote growth of bacteria, fungi or mildew with possible attendant unpleasant odor, contamination or even possibly a health hazard. This potential problem has already been previously recognized, and it is for this and similar reasons that the so-called self-draining pumps have been developed.

So, for instance, there has already been proposed a self-draining pump construction in which a small aperture is provided in the pump housing assembly, this aperture communicating with the lowermost region of the pumping chamber and being connected, during the installation of the self-draining pump, to a drain, so that some of the water from the pumping chamber, which constitutes the high-pressure side of the pump, is drained into the drain even during the normal operation of the pump. Obviously, this is highly wasteful of energy since some of the usually heated water is drained out of the system and may have to be replenished with additional water which usually has to be heated before being introduced into the system. This energy waste is additional to the wasted energy resulting from the fact that some of the previously pressurized water goes into the drain.

On the other hand, it has also already been proposed to provide an adaptor for a pump with a central axial inlet nipple, which adaptor bounds an adaptor passage that leads downwardly from the central passage of the inlet nipple to an elevation low enough to be in substantial horizontal alignment with the bottom region of the pumping chamber of the pump, and to provide a draining passage with a relatively small cross sectional area in the pump housing and/or the adaptor between the bottom region of the pumping chamber and the lowermost region of the adaptor passage. However, experience with pumping arrangements of this type has shown that numerous problems resulting from the provision of the separate adaptor, including but not limited problems with sealing the additional interface between the adapter and the lid of the pump housing on which the adator is mounted, are encountered in this particular pump construction.

SUMMARY OF THE INVENTION

Accordingly, it is a general object of the present invention to avoid the disadvantages of the prior art.

More particularly, it is an object of the present invention to provide a self-draining pumping arrangement which does not possess the drawbacks of the known pump constructions of this type.

Still another object of the present invention is to develop a pump arrangement of the type here under consideration which will render it possible to achieve complete pump draining without running into the difficulties encountered in the known constructions.

It is yet another object of the present invention so to construct the arrangement of the above type as to be able to easily and reliably seal the same.

A concomitant object of the present invention is so to design the pump arrangement of this type as to be relatively simple in construction, inexpensive to manufacture, easy to use, and reliable in operation nevertheless.

In pursuance of these objects and others which will become apparent hereafter, one feature of the present invention resides in a self-draining pump comprising a pump housing bounding an impeller chamber which has a central axis that is substantially horizontal in a position of use of the pump and an open end facing in one axial direction, the pump housing further bounding an output passage which communicates with a radially outward region of the impeller chamber; an impeller received in the impeller chamber for rotation about the central axis for impelling fluid present in the impeller chamber from a radially inward region toward the radially outward region of the latter; and a lid including a mounting portion mounted on the pump housing for closing the open end of the impeller chamber, an inlet portion axially spaced from the mounting portion and bounding an inlet passage which is centered on an inlet axis that is substantially parallel to the axis and offset therefrom by such a distance that a bottom zone of the inlet passage is at an elevation no higher than a bottom zone of the impeller chamber in the position of use, a connecting portion bounding an internal space connecting the inlet passage with a radial section of the impeller chamber which extends from the radially inward region to the bottom zone of the impeller chamber, and a partitioning wall situated in the internal space and delimiting therein a connecting passage leading from the inlet passage to the radially inward region of the impeller chamber and separating such connecting passage from the remainder of the internal space and of the section, the partitioning wall including at least one aperture of a limited cross section which communicates the bottom zone of the impeller chamber with the bottom zone of the inlet passage for draining fluid from the bottom zone of the impeller chamber when the inlet passage is connected to a drain.

A particular advantage of this arrangement is that, since the offset inlet nipple and the connecting portion are constitutent parts of the lid, there is no need to provide any sealing means in addition to those which are needed in any event to seal the interface between the lid and the pump housing. Moreover, the construction and assembly of this pump is relatively simple, particularly when the partitioning wall is constituted by an insert separate from the remainder of the lid and fittingly received in a receiving recess of such lid.

BRIEF DESCRIPTION OF THE DRAWING

Above-mentioned and other features and objects of this invention will become more apparent by reference to the following description taken in conjunction with the accompanying drawings, in which.

DETAILED DESCRIPTION OF THE PREFERRED EMBODIMENT

Figure 1:
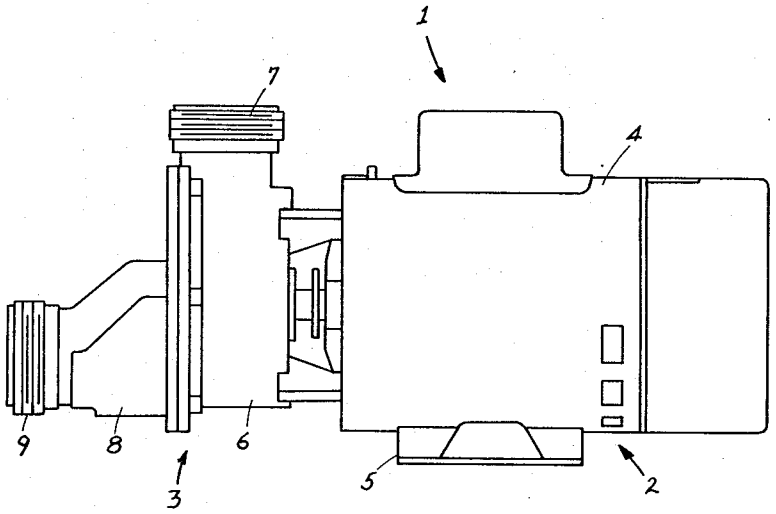
FIG. 1 is a side elevational view of a pumping arrangement embodying the present invention.

Referring now to the drawing in detail, and first to FIG. 1 thereof, it may be seen that the reference numeral 1 has been used therein to identify a pumping arrangement embodying the present invention. The pumping arrangement 1 includes, as its main components, a motor 2, especially an electric motor, and a pump 3 which is mounted on the motor 2.

Figure 2:
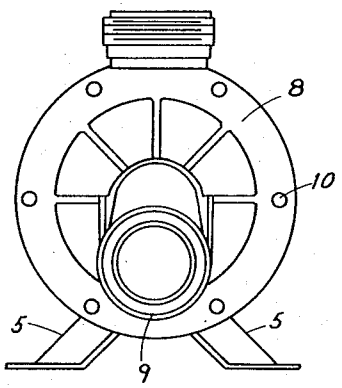
Fig. 2 is an end elevational view of the pumping arrangement of FIG. 1.

The motor 2 is of any known construction and includes a motor housing 4 which is to be mounted on a support by means of a mounting arrangement 5 which may include, for example 5 as illustrated in FIG. 2 of the drawing 5 mounting legs which may be rigid with or constitute parts of a mounting bracket that is rigidly connected to the motor housing 4 and are provided with respective holes for the passage of connecting screws or bolts connecting such legs to the support therethrough. In the following discussion, it will be assumed, unless otherwise indicated, that the motor housing 4 will be mounted on the support in the illustrated position, that is, on a substantially horizontal surface of the support.

The pump 3 includes a pump housing 6 which is provided with a radially extending outlet nipple 7 and is rigidly connected, in any known manner, to the motor housing 4, and a lid 8 which is provided with an axially extending inlet nipple 9 and is mounted on the pump housing 6 by means of screws or similar fastening elements 10. For the above-mentioned assumed position of use of the motor housing 4 of the pumping arrangement 1, the lid 8 will be mounted on the pump housing 6 in the illustrated orientation. However, either the pump housing 6 may be mounted on the motor housing 4 in any desired one of a plurality of other angularly displaced positions relative to the motor housing 4, or the mounting arrangement 5 for the motor housing 4 may include the aforementioned mounting bracket which is separate from the motor housing 4 so as to be angularly displaceable about the same and connectable to the motor housing 4 in any angularly displaced position relative thereto, so that the lid 8 will always assume the aforementioned orientation in space, regardless of the orientation of the support surface on which the pumping arrangement 1 is mounted.

Figure 3:
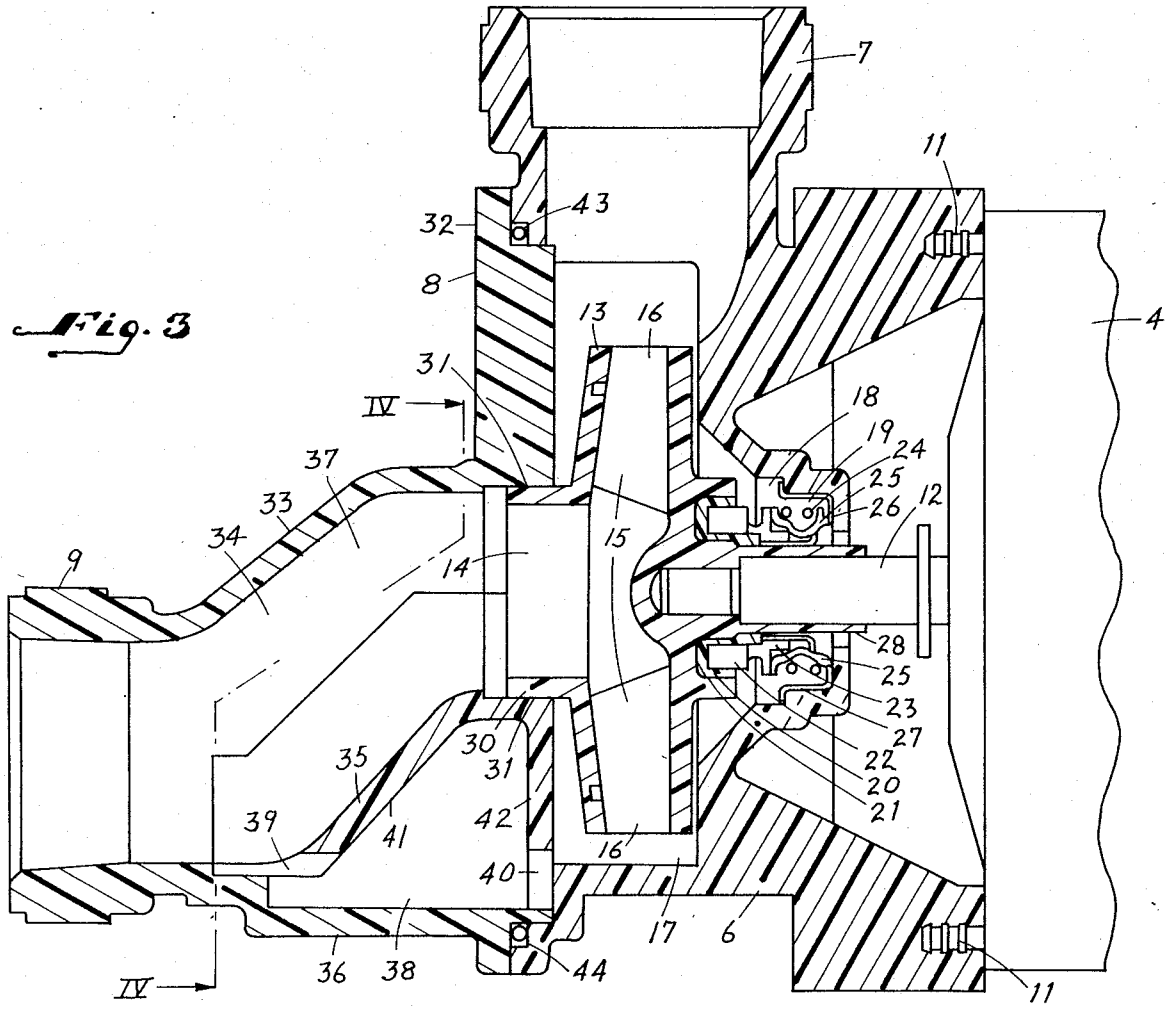
FIG. 3 is an axial sectional view through a pump of the arrangement of FIGS. 1 and 2, taken on line III—III of FIG. 2.

As shown particularly in FIG. 3, the motor housing 4 and the pump housing 6 are connected with one another by a plurality of studs or other similar connecting elements 11. The motor 2 includes an output shaft which rotates during the operation of the motor 2 about its longitudinal axis and has an end portion 12 which axially projects out of the motor housing 4 and into the interior of the pump housing 6. An impeller 13 is mounted on the output shaft end portion 12 for joint rotation therewith. The impeller 13 is of a known construction and includes an axial inlet 14, a plurality of impeller vanes 15, and a plurality of substantially radially opening outlets 16. During the rotation of the impeller 13 with the output shaft end portion 12, fluid being pumped will enter the impeller 13 through the axial inlet 14 and be impelled by the vanes 15 to move radially outwardly and eventually exit the impeller 13 through the respective outlets 16 to enter a high-pressure space or pumping chamber 17 provided in the pump housing 6 around the impeller 13 and to flow therefrom into the outlet nipple 7 and from there to the desired destination.

The pump housing 6 includes an axial protuberance 18 which surrounds a region of the output shaft end portion 12 and accommodates a sealing arrangement 19. The sealing arrangement 19 includes a sealing boot 20 of an elastomeric material which is received in a recess 21 of the impeller 13, a sealing ring 22 of a ceramic material partially received in the recess 21 adjacent to and in sealing contact with the sealing boot 20 and partially projecting out of the recess 21, another sealing ring 23 of a self-lubricating material, such as carbon, which is pressed in contact with the ceramic sealing ring 22 by a helical compression spring 24, and another sealing boot 25, as well as a metallic shell 26 which is fittingly received in a recess 27 of the protuberance 18 and accommodates the spring 24 and the sealing boot 25. The sealing boot 20 and the ceramic sealing ring 22 rotate with the output shaft end portion 12 and with the impeller 13, while the carbon sealing ring 23, the spring 24, the sealing boot 25 and the shell 26 are stationary relative to the pump housing 4 when assembled therewith. The output shaft end portion 12 and a sleeve-shaped mounting portion 28 of the impeller 13 which surrounds a predetermined part of the output shaft end portion 12 pass through the interior of the sealing arrangement 19 with respective radial clearances.

The inlet 14 of the impeller 13 is bounded by a tubular inlet portion 30 of the impeller 13. The tubular inlet portion 30 of the impeller is received, preferably with a minimum clearance, in a cylindrical recess 31 of the lid 8. The lid 8 includes, in addition to the aforementioned inlet nipple, a substantially plate-shaped closing portion 32, and a connecting portion 33 which connects the closing portion 32 with the inlet nipple 9 and is integral with both. The connecting portion 33 bounds an internal space 34 which communicates with the interior of the inlet nipple 9, on the one hand, and with the interior of the pump housing 6, on the other hand.

At its axial end that is closer to the impeller 13, the internal space 34 opens into the recess 31 which is partially bounded by the plate-shaped lid portion 32 and is coaxial with the inlet 14 of the impeller 13, and extends radially outwardly and downwardly therefrom to and beyond the bottom region of the pumping chamber 17. Thus, if the interior of the inlet nipple 9 and thus the internal space is connected with a drain, the fluid present in the interior of the pump housing 6 will flow out into the internal space 34 and from there through the interior of the inlet nipple 9 into the drain not only from the region of the central recess 31, but also from the pumping chamber 17, including the bottom region of the latter. In this manner, it is assured that none of the fluid will remain in the interior of the pump housing 6 where its presence could create a health hazard or create conditions for undesirable contamination by bacteria, fuhgus, mildew or the like. Such complete draining is particularly useful and, in many instances, even required, when the pumping arrangement 1 is to be used for recirculating water, for instance, in a spa or a whirlpool bath, where the likelihood of such undesired growth in the presence of water is quite pronounced.

However, in the absence of any restrictions on the flow of the fluid into and out of the internal space 34, fluid being pumped would be constantly recirculated through the internal space 34 between the pumping chamber 17 and the inlet 14 of the impeller, so that the pump 3 would work very inefficiently, if at all. Therefore, the lid 8 of the pumping arrangement 1 of the present invention is provided in the internal space 34 thereof with a trough-shaped partitioning wall 35 which, in the illustrated construction, is constituted by an element or insert separate from the connecting portion 33 and the remainder of the lid 8. The insert or partitioning wall 35 completes the radial delimitation of the recess 31. The insert 35 is received, with a minimum if any clearance, in a receiving recess 36 of the lid 8 and partially delimits a feeding passage 37 in the internal space 34, the feeding passage 37 leading from the interior of the inlet nipple 9 to the recess 31 and thus to the inlet 14 of the impeller 13, while separating the remainder of the internal space 34 from the feeding passage 37.

As shown, the insert or partitioning wall 35 does not completely fill the remainder of the internal space 34; rather, it bounds a hollow space 38 which communicates with the passage 37 via a relatively small aperture 39, and with the pumping chamber 17 via another relatively small aperture 40. The apertures 39 and 40 act as flow restrictors or throttles, thus assuring that only an acceptable minimum amount of the pressurized fluid present in the pumping chamber 17 will escape during the pumping operation of the pumping arrangement 1 into the hollow space 38 and from there into the feeding passage 37 to be recirculated back to the inlet 14 of the impeller 13. 0n the other hand, the apertures 39 and 40 permit the fluid to be drained even from the bottom region of the pumping chamber 17 first into the hollow space 38 and then into the feeding passage 37 and the interior of the inlet nipple 9 when the pumping arrangement 1 is at a standstill and the inlet nipple 9 is connected to a drain. Of course, to achieve such complete draining of the pumping chambers 17, the bottom portion of the interior of the inlet nipole 9 has to be at an elevation not higher than the bottom portion of the pumping chamber 17. To this end, the inlet nipple 9 is radially downwardly offset by the required distance from the recess 31, and the connecting portion 33 and particularly the passage 37 follow an arcuate course.

As illustrated particularly in FIG. 3, the insert includes a substantially trough-shaped or U-shaped portion 41 which extends along an arcuate course between the bottom region of the interior of the inlet nipple 9 and the central or radially inward region of the interior of the pump housing 6, and a closing portion 42 which extends substantially radially outwardly and downwardly from the portion 42 to close a section of the open end of the interior of the pump housing which is left open by the mounting portion 32 and extends between the radially inward region and the bottom region of the pumping chamber 17. The apertures 39 and 40 are then provided in the portions 41 and 42, respectively.

As already mentioned before, the lid 8 is mounted on the pump housing 6 by means of the fastening elements 10 which have not been shown in FIG. 3 since they are located outside the cross-sectional plane. To seal the lid 8 with respect to the pump housing 6, there is provided a sealing ring 43 which is received in a groove 44 of the pump housing 6 and sealingly contacts both the pump housing 6 and the lid 8 at the region of the groove 43. No separate sealing for the insert 35 is, nor need it be, provided, since any leakage past the insert 35 will have a negligible, if any effect and, in any event, such leakage would be into the feeding passage 37 and not to the exterior of the pump 3, so that it is not objectionable or bothersome.

Figure 4:
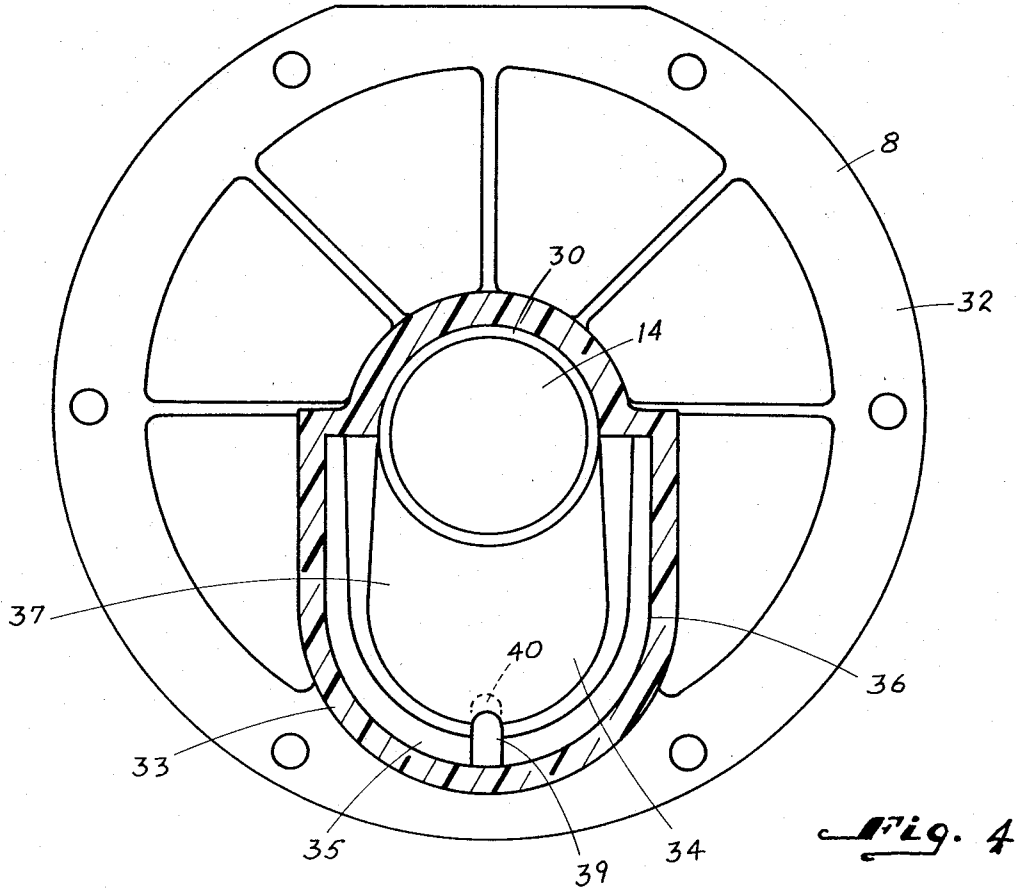
Fig. 4 is a cross-sectional view taken on line IV—IV of FIG. 3.

Further details of the insert 35 and of its accommodation in the internal space 34 may be ascertained from FIG. 4 of the drawing. It may be seen therein that the receiving recess 36 and the insert 35 have substantially U-shaped compatible or complimentary cross-sectional configurations, so that the insert 35 is received in the receiving recess 36 with hardly any leeway. It is also evident from FIG. 4 that the apertures 39 and 40 are located centrally of the insert 34 and thus indeed in axial alignment with the lowermost portion of the interior of the pump housing 6, and that the cross section of the passage 37 has a substantially U-shaped semicircular configuration which gradually changes from a relatively larger diameter which corresponds to that of the interior of the inlet nipple 9 at an upstream end thereof to a relatively smaller diameter at the downstream end thereof which communicates with the inlet 14 bounded by the inlet portion 30 of the impeller 13.

While I have described above the principles of my invention in connection with specific apparatus, it is to be clearly understood that this description is made only by way of example and not as a limitation to the scope of my invention as set forth in the objects thereof and in the accompanying claims.

I claim:

1. A self-draining pump arrangement comprising a motor including a motor housing and an output shaft rotatable about an axis which is substantially horizontal in a position of use of the arrangement and having a free end portion axially projecting out of said motor housing; a pump housing stationarily arranged around said end portion of said output shaft and bounding an impeller chamber which is substantially coaxial with said output shaft and has an open end facing away from said motor housing, and an output passage which communicates with a radially outward region of said impeller chamber; an impeller received in said impeller chamber and connected to said end portion of said output shaft for joint rotation therewith for impelling fluid present in said impeller chamber from a radially inward region toward said radially outward region of the latter; and a lid including a mounting portion mounted on said pump housing for closing said open end of said impeller chamber, an inlet portion axially spaced from said mounting portion and bounding an inlet passage which is centered on an inlet axis that is substantially parallel to said axis and offset therefrom by such a distance that a bottom zone of said inlet passage is at an elevation no higher than a bottom zone of said impeller chamber in said position of use, a connecting portion bounding an internal space connecting said inlet passage with a radial section of said impeller chamber which extends from said radially inward region to said bottom zone of said impeller chamber, and a partitioning wall situated in said internal space and delimiting therein a connecting passage leading from said inlet passage to said radially inward region of said impeller chamber and separating such connecting passage from the remainder of said internal space and of said section, said partitioning wall including at least one aperture of a limited cross section which communicates said bottom zone of said impeller chamber with said bottom zone of said inlet passage for draining fluid from said bottom zone of said impeller chamber when said inlet passage is connected to a drain.

2. The pump arrangement as defined in claim 1, wherein said partitioning wall is constituted by an insert separate from the remainder of said lid and received in a compatibly configurated receiving recess of said connecting and mounting portions of said lid.

3. The pump arrangement as defined in claim 2, and further including means for sealing said lid relative to said pump housing, said sealing means being arranged between said mounting portion of said lid and said pump housing outwardly of and remotely from said insert.

4. The pump arrangement as defined in claim 1, wherein said partitioning wall delimits a hollow space in said remainder of said internal space, and wherein said aperture includes a first aperture portion which communicates said bottom zone of said impeller chamber with said hollow space, and a second aperture portion which communicates said hollow space with said bottom zone of said inlet passage.

5. The pump arrangement as defined in claim 4, wherein said partitioning wall has a substantially trough-shaped portion partially delimiting said connecting passage, and a closing portion extending substantially radially from said trough-shaped portion to close off said section of said impeller chamber between said radially inward region and said bottom zone, said trough-shaped and closing portions together bounding said hollow space; and wherein said first aperture portion is provided in said closing portion and said second aperture portion is provided in said through-shaped portion.

6. A self-draining pump comprising a pump housing bounding an impeller chamber which has a central axis that is substantially horizontal in a position of use of the pump and an open end facing in one axial direction, said pump housing further bounding an output passage which communicates with a radially outward region of said impeller chamber; an impeller received in said impeller chamber for rotation about said central axis for impelling fluid present in said impeller chamber from a radially inward region toward said radially outward region of the latter; and a lid including a mounting portion mounted on said pump housing for closing said open end of said impeller chamber, an inlet portion axially spaced from said mounting portion and bounding an inlet passage which is centered on an inlet axis that is substantially parallel to said axis and offset therefrom by such a distance that a bottom zone of said inlet passage is at an elevation no higher than a bottom zone of said impeller chamber in said position of use, a connecting portion bounding an internal space connecting said inlet passage with a radial section of said impeller chamber which extends from said radially inward region to said bottom zone of said impeller chamber, and a partitioning wall situated in said internal space and delimiting therein a connecting passage leading from said inlet passage to said radially inward region of said impeller chamber and separating such connecting passage from the remainder of said internal space and of said section, said partitioning wall including at least one aperture of a limited cross section which communicates said bottom zone of said impeller chamber with said bottom zone of said inlet passage for draining fluid from said bottom zone of said impeller chamber when said inlet passage is connected to a drain.

7. The pump arrangement as defined in claim 6, wherein said partitioning wall is constituted by an insert separate from the remainder of said lid and received in a compatibly configurated receiving recess of said connecting and mounting portions of said lid.

8. The pump arrangement as defined in claim 7, and further including means for sealing said lid relative to said pump housing, said sealing means being arranged between said mounting portion of said lid and said pump housing outwardly of and remotely from said insert.

9. The pump arrangement as defined in claim 6, wherein said partitioning wall delimits a hollow space in said remainder of said internal space, and wherein said aperture includes a first aperture portion which communicates said bottom zone of said impeller chamber with said hollow space, and a second aperture portion which communicates said hollow space with said bottom zone of said inlet passage.

10. The pump arrangement as defined in claim 9, wherein said partitioning wall has a substantially trough-shaped portion partially delimiting said connecting passage, and a closing portion extending substantially radially from said trough-shaped portion to close off said section of said impeller chamber between said radially inward region and said bottom zone, said trough-shaped and closing portions together bounding said hollow space; and wherein said first aperture portion is provided in said closing portion and said second aperture portion is provided in said through-shaped portion.

* * * * *